US005330631A

United States Patent [19]

Juric et al.

[11] Patent Number: 5,330,631

[45] Date of Patent: Jul. 19, 1994

[54] ALUMINIUM SMELTING CELL

[75] Inventors: Draco D. Juric, Camberwell; Raymond W. Shaw, Woodend; Geoffrey J. Houston, Ashburton; Ian A. Coad, Kingsbury, all of Australia

[73] Assignee: Comalco Aluminium Limited, Melbourne, Australia

[21] Appl. No.: 969,850

[22] PCT Filed: Aug. 19, 1991

[86] PCT No.: PCT/AU91/00372

§ 371 Date: Mar. 26, 1993

§ 102(e) Date: Mar. 26, 1993

[87] PCT Pub. No.: WO92/03597

PCT Pub. Date: Mar. 5, 1992

[30] Foreign Application Priority Data

Aug. 20, 1990 [AU] Australia ..... PK1843

[51] Int. Cl.[5] ..... C25C 3/08

[52] U.S. Cl. ..... 204/243 R; 204/247; 204/289

[58] Field of Search ..... 204/67, 243 R-247, 204/289

[56] References Cited

U.S. PATENT DOCUMENTS

| | | | |
|---|---|---|---|
| 3,501,386 | 3/1970 | Johnson | 204/247 X |
| 4,376,690 | 3/1983 | Kugler | 204/243 R |
| 4,405,433 | 9/1983 | Payne | 204/243 R X |
| 4,462,886 | 7/1984 | Kugler | 204/243 R X |
| 4,602,990 | 7/1986 | Boxall et al. | 204/247 X |
| 5,043,047 | 8/1991 | Stedman et al. | 204/243 R X |

*Primary Examiner*—Donald R. Valentine

*Attorney, Agent, or Firm*—Nikaido, Marmelstein, Murray & Oram

[57] ABSTRACT

An aluminium smelting cell comprising a floor defining a cathode surface (4) which is substantially horizontal in the longitudinal direction of an overlying anode (1), shaped structures (2,3) projecting from the cathode surface (4) and having exposed surfaces of aluminium wetted material, the shaped structures being positioned to cause preferential contouring of the anode (1), particularly at its longitudinal edges (5,6) to allow for improved bubble release and to minimize cell resistivity.

14 Claims, 9 Drawing Sheets

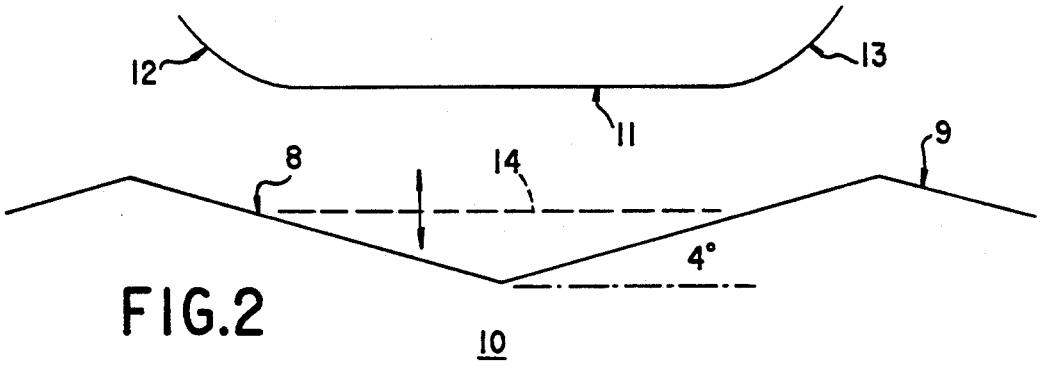
FIG.2
FIG.3
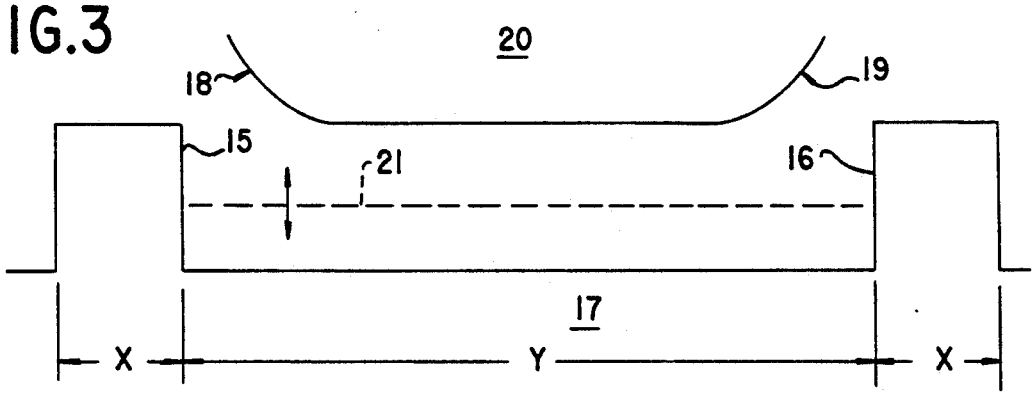
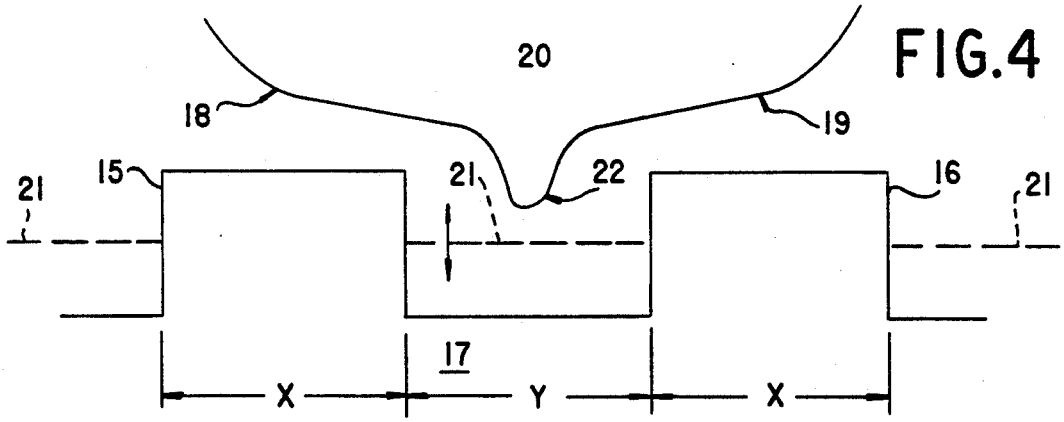
FIG.4
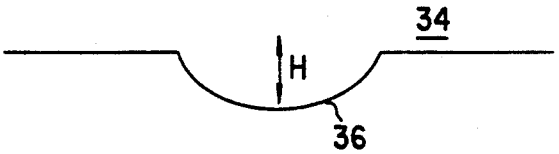
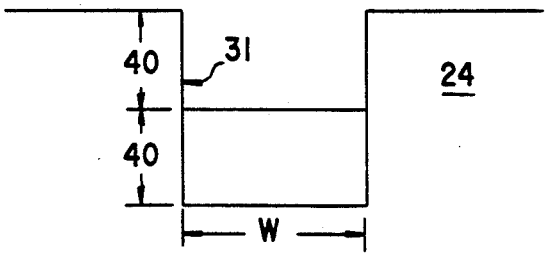
FIG.6

ALUMINIUM SMELTING CELL

FIELD OF THE INVENTION

This invention relates to improvements in aluminium smelting cells.

BACKGROUND OF THE INVENTION

The patent literature displays a wide range of proposals for smelting cells having improved performance, but none of these appear to be in current commercial operation, and most have some notable problems notwithstanding the claimed performance improvement.

In Payne U.S. Pat. No. 4,405,433 bubble release under the anode is described as being improved by the use of differential reactivity carbon. Improved bubble release by the use of steeply shaped anode/cathode sections is also outlined by Reynolds in their testwork. Improved resistivity performance was claimed by both but neither has been implemented on a commercial basis.

The patent literature also discloses the use of wettable materials ($TIB_2$ based) which protrude from the metal pad as platforms or pedestals to yield an active cathode surface. These give a power reduction through reduced ACD but the effect is limited due to no gain in bubble release mechanisms at the anode. These types of cells have not been proven commercially viable, presumably because of a combination of material problems and the cost of construction. The cathode area available beneath the anode is also reduced compared to that of a flat metal pad when platforms or pedestals are used. In this type of cell the metal pad plays little role in carrying active current in the cell operations and is regarded as "non-active".

Another approach to minimizing ACD was that adopted by Seager (U.S. Pat. No. 3,492,208) who employed a wetted cathode material in a horizontal cell which was said to either continually drain into a sump region for collection for ease of tapping, or in which the metal pad was restricted to below 5 cm. Power savings were claimed to be achieved through the use of lower ACD's and due to the absence of magnetically driven movement of the metal pad experienced in conventional cells. However the trials described in the patent were only conducted at low amperage (10 kA) and no evidence was presented to indicate whether these conditions would hold at much higher amperage such as is now typically being used in the industry (80–300 Ka) and where electromagnetic disturbances of the metal are known to be a problem.

Boxall et al and others (e.g. U.S. Pat. No. 4,602,990) have adopted the use of angled drained cells to give both the benefits of low ACD operation and improved bath circulation by directional bubble release. With these cells bath circulation was considered critically important at low ACD operation. However, the bubble resistance problem remained.

Stedman et al (Australian Patent Application No. 50008/90 and U.S. Ser. No. 07/481847) have developed cells with improved performance by the use of a shaped cathode to induce shaping in the anodes to yield a anode having a double slope arrangement including a continuous longitudinal slope of the type envisaged by Boxall et al in U.S. Pat. No. 4,602,990, or having an induced bevelled section at its longitudinal edges.

Cells of this type have been trialled commercially but still suffer from some disadvantages in:

(i) increased construction complexity through the need for a large sump and for a special superstructure to hold sloping anodes.

(ii) inefficient use of the anodes' carbon mass due to the angled profile not matching the horizontal surface of the bath, thus yielding anode rota problems.

These problems become more pronounced within larger cells using larger anodes, and produce difficulties in the ease of retrofit to existing plant conditions and/or work practices.

SUMMARY OF INVENTION AND OBJECT

It is an object of the present invention to provide an improved aluminium smelting cell structure which facilitates adequate bubble release and electrolyte flow and low ACD operation using a less complex cell structure and less changes to the anode supporting superstructure.

In a first aspect, the invention provides an aluminium smelting cell comprising side walls and a floor defining a cathode surface, at least one anode having an active electrode surface spaced from and substantially parallel to said cathode surface to define an interelectrode gap, characterized by said cathode surface being substantially horizontal in the longitudinal direction of said anode(s) and by shaped structures projecting from said cathode surface, said structures being covered by wetted cathode material and being shaped to modify the current distribution between the anode(s) and the cathode whereby current flows through said shaped structures and through the remaining cathode portions to cause preferential shaping of the anode(s) to encourage shortening of the release path of bubbles under said anode(s) to thereby minimize cell resistivity and enable operation at a reduced anode to cathode distance.

In the present specification "horizontal" means a slope of no greater than about 2° in the longitudinal direction of the anodes.

Unlike prior art cell designs, the cathode regions adjacent the shaped cathode structures remain active as cathode areas and do not substantially increase cathode current density over that found in conventional cells. Other cells having cathode protrusions (or pedestals) are active essentially only on the protruding areas thereby resulting in increased cathodic current density.

The metal level in the substantially flat cathode regions may vary from the fully drained mode up to a depth of 10 cm or more depending on the height of the shaped structures. To gain the full benefit from the new cell design, the depth should not exceed that of the shaped structures for an extended time period as this will prevent the anodes profiling to provide the desired bubble releases. This enables metal storage throughout the entire cell and removes the need for a large and invasive sump and/or for short tapping cycles. Advantages of simpler cell construction, elimination of a substantial sump as a weak point in cell construction and better plant operations result from the use of such shaped structures.

The metal level may be allowed to rise above the level of the shaped structures for limited time periods after anode profiling has occurred, and in certain circumstances this can be additionally advantageous, e.g. as a temporary increase in metal reserve storage. With this design the cells are able to revert to the intended mode of operation with a metal pad, if such an operation is desired.

The new cell design therefore allows flexibility of cell operation as either:

(a) thin film wetted cathode (horizontally drained); or (b) thick film (pool) wetted cathode (horizontal undrained).

These shaped structures can be built as an integral part of a new cell or can be retrofitted to cells, possibly as modular inserts or sections in an existing cell, which may or may not have a wetted horizontal cathode surface, without necessarily being bonded or fixed to the cathode surface. In this arrangement, the metal provides the necessary conductive path and the modular inserts will have sufficient density and mass to remain in position without fixing or bonding. This provides a distinct advantage since bonding and fixing of wettable surfaces to the base of the cell is a widely recognized problem in the construction of aluminium smelting cells containing wettable cathodes.

The above described substantially horizontal cell was trialled and it was surprisingly found that contrary to established cell theory:

(i) The bath circulation rates obtained, although low, were adequate to provide sufficient alumina under each anode such that continuous electrolysis was possible without the occurrence of excessive anode effects, even at very low ACD's.

(ii) That allowing the metal layer to build-up did not lead to the excessive magnetohydrodynamic metal movement usually expected, despite non-uniform current paths caused by thickness variations in the metal layer, or to any significant decrease in current efficiency.

(iii) Low ACD operation was possible, anode burn profiles of the desired shape could be attained, and both could be controlled even when disturbing pot operational aspects, such as tapping and anode setting, were occurring. The anode profile burning was consistent with supporting electrical modelling.

The shaping of anodes to provide enhanced bubble release is important for reducing the resistance in the ACD. Additionally the shaping of anodes to obtain the semi-continuous and gradual release of bubbles by strategically-placed cathode protrusions was also found to be especially important for the stable operation of the present cells when a metal pad of significant thickness (i.e. under non-thin film conditions) resides as an active cathode.

In conventional cells, an approximately 1 Hz frequency of periodic release of accumulated gas volume from under the anodes is known to occur. When this strong venting occurs in conjunction with a pool of liquid metal, deformation of the metal surface occurs leading to the initiation of waves and a propensity for increased metal dissolution, and therefore conditions that promote a decrease in current efficiency.

The design of an anode shape to produce controlled bubble release, which eliminates the strong periodic venting action, was found to substantially minimize distortions at the bath-metal interface and thereby preventing decreases in the CE.

BRIEF DESCRIPTION OF THE DRAWINGS

FIG. 2 is a end elevation similar to FIG. 1 showing a schematic representation of an anode and triangular cathode protrusion combination according to a second embodiment of the invention;

FIGS. 3 and 4 show further embodiments of the invention in which the cathode protrusions are rectangular and are arranged at various spacings;

FIG. 6 is a schematic representation of the anode shaping produced by the embodiment of FIG. 5;

DESCRIPTION OF THE PREFERRED EMBODIMENTS

Figure 1:
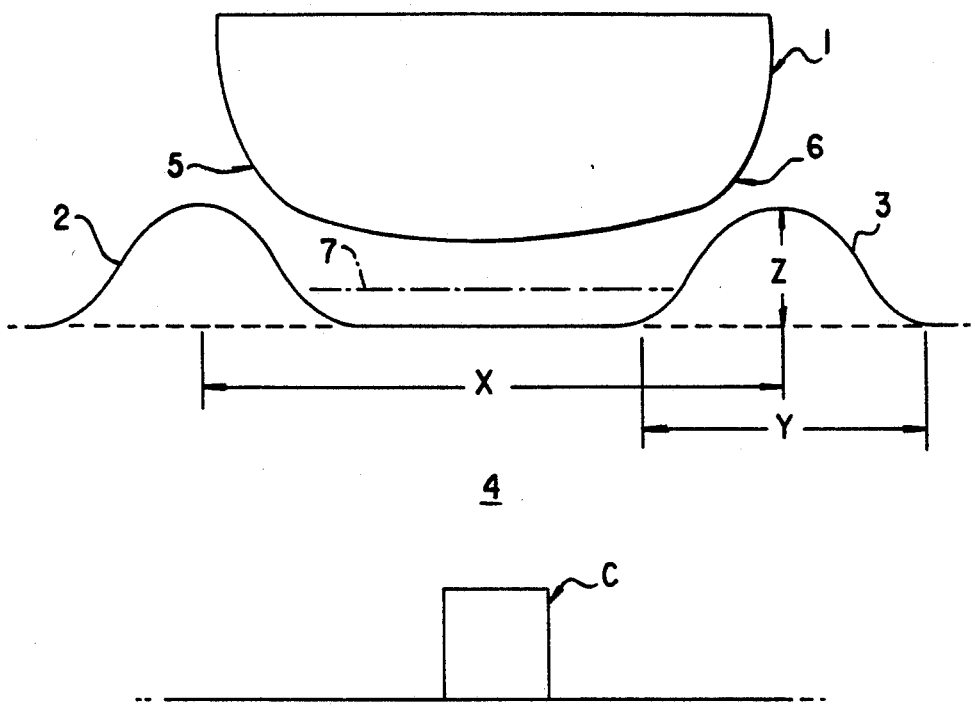
FIG. 1 is a schematic end elevation of a typical anode cathode protrusion combination embodying the invention.

Cells incorporating anode cathode arrangements of the general types shown in FIGS. 1, 2 and 3 have been operated on a limited experimental basis in the applicant's smelter. In the arrangement shown in FIG. 1 of the drawings, each anode 1 has two associated spaced projections 2,3 of generally rounded triangular cross-section formed in the surface of the cathode 4, having an embedded current collector bar C, adjacent either side of each anode 1. The projections 2,3 may be formed as part of the construction of the cathode 4 of the cell or may be retro-fitted to an existing cell in any suitable manner known in the art. The surface of each projection 2,3 and the intervening cathode surface 4 is covered by a suitable wetted cathode material, such as a $TiB_2$-containing composite of the type known in the art. The positioning of the projections as shown in FIG. 1 will cause the longitudinal edges 5,6 of the anode 1 to be burnt away or profiled to the shape shown to thereby encourage bubble release and adequate bath circulation. A pool of metal 7 collects between the projections 2,3, and this pool may be controlled to be of any desired depth including above the top of the projections 2 and 3, although this depth of metal should not be maintained for a prolonged period (more than a few days) otherwise the anode profiling will be lost and the anode will revert to a standard flat bottomed anode.

The dimensions employed (X, Y, Z) and the depth of the metal pool 7 can vary over a considerable range depending upon the total cell dimensions, the anode dimensions and the operating system desired. The separation of the protrusions (X) is largely set by the anode size with the desired system having protrusions towards each edge of the anode. Typical anodes currently used in cells can range from under 400 mm to over 800 mm wide. The height and shape of the protrusions depends upon the depth of metal desired (for storage) and upon the desired shape of and degree of profiling or rounding of the anodes. For a small anode such as used in the applicant's trials referred to below, this would typically be of the order of 50–100 mm (dimension Z) but this can readily be changed. The size of the protrusion as set by dimensions Y and Z depends upon the degree of profiling or rounding desired to be induced in the anode. Typically dimension Y would be of the order of 2–5 times dimension Z but the range can extend beyond that in special cases. The depth of metal used can vary as in trials of the cell shown in FIGS. 5 from <5 mm up to the height of the protrusions (>100 mm) depending on needs.

Figure 1A:
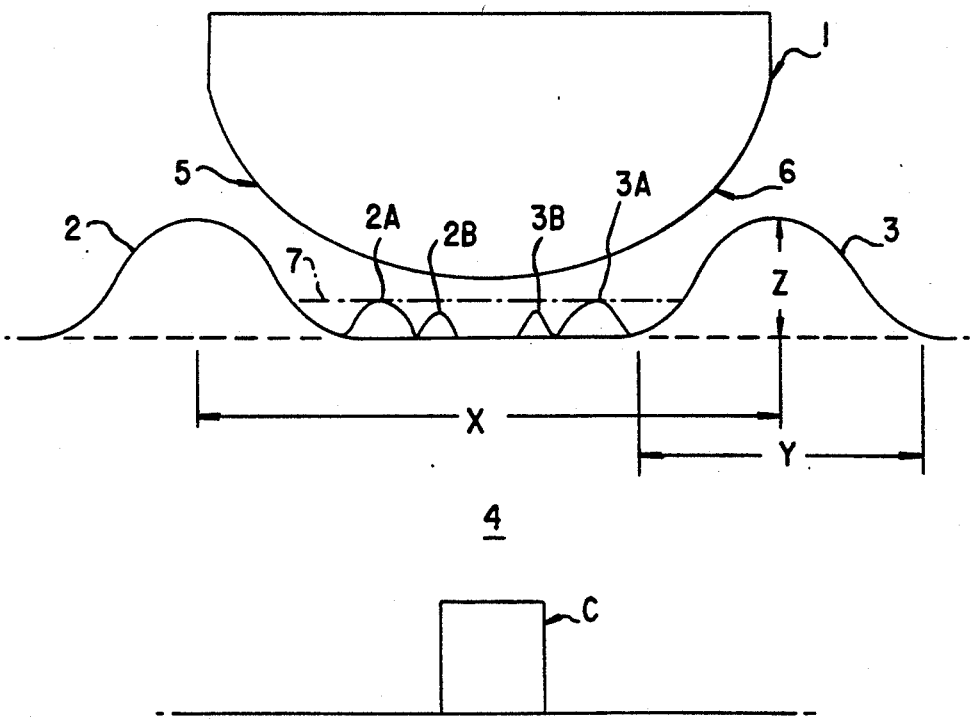
FIG. 1A is an end elevation schematically illustrating a modification to the embodiment of FIG. 1.

In the case where large anodes are used and dimension X is large, additional protrusions may be added within this area as baffles to reduce any metal movement and to maintain a defined ACD that induces the profiling on tapping the metal out. One suitable modification of this type is shown in FIG. 1A of the drawings in which additional smaller projections 2A, 2B, 3A, 3B are formed between the main projections 2 and 3. The projections become progressively smaller and may be necessary to maintain a defined ACD that induces the profiling when the depth of the metal pool is reduced below the level of the additional protrusions. The additional protrusions may take any desired form and may even be constituted by an array of upstanding cubic structures suitably positioned to provide the necessary defined ACD and to reduce unwanted metal movement in a large cell having wide anodes.

In the arrangement shown in FIG. 2 of the drawings, two generally triangular projections or protrusions 8,9 are formed on the surface of the cathode 10 immediately under each anode 11 such that a generally V-shaped profile is present under each anode. This causes the edges 12,13 of the anode 11 to be burnt away in the manner shown in FIG. 2 to thereby encourage efficient bubble release and bath circulation. In the embodiment shown, the surfaces defining the V-profile are inclined at about 4° to the horizontal. A pool of metal 14 of variable depth is held between the projections 8 and 9.

In the embodiments shown in FIGS. 3 and 4 of the drawings, generally rectangular projections 15,16 are formed in the surface of the cathode 17 and cause shaping of the edges 18,19 of the anode 20 in the manner shown in the figure. The dimensions x and y may vary quite considerably as shown in FIG. 4, although in each embodiment a central generally rectangular channel of varying dimensions is defined within which a pad of metal 21 of varying depth collects under each anode 20. In the embodiment of FIG. 4, the shaping of the edges 18,19 proceeds further inwardly of the anode 20 to define a downwardly extending peak 22 as shown.

Figure 13:
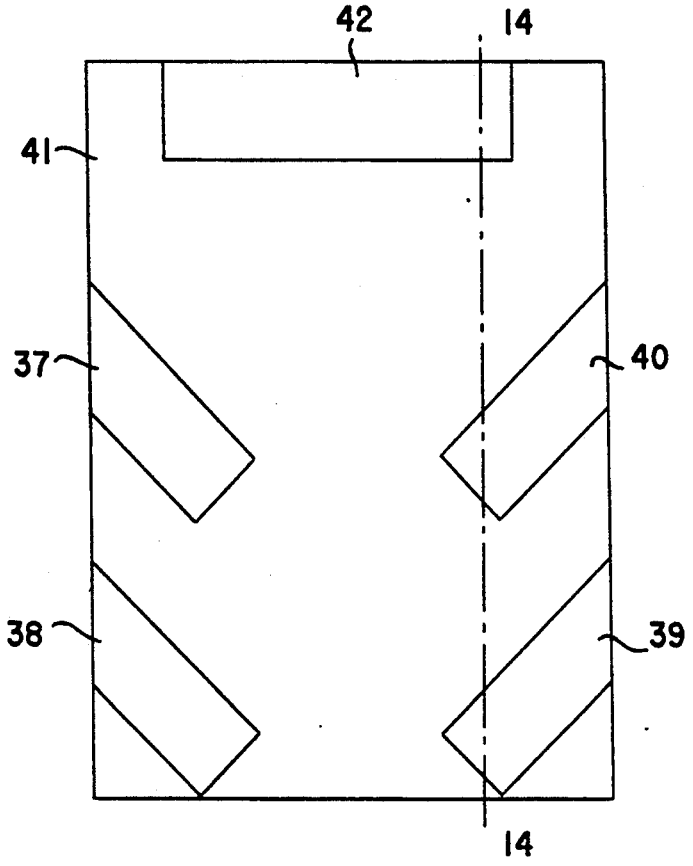
FIG. 13 is a schematic plan view of a cathode protrusion arrangement according to another embodiment of the invention.

In the embodiments of FIGS. 1 to 4 of the drawings, the projections or protrusions 8 and 9, and 15 and 16, extend along the longitudinal edges of the anode and may terminate centrally of the cell in a flat cathode surface or in a less pronounced depressed central metal collection channel or trench. At the side walls of the cell, a side channel may be provided or the projections may abut directly against the side wall. If desired, transverse protrusions, of the type shown in FIGS. 13 and 14 described further below, or in FIG. 15 of Australian Paten Application No. 50008/90 may be provided to provide bevelling of the side edges and/or end edges of the anodes for the reasons discussed in our earlier patent application above. A cell constructed in accordance with the embodiment of FIG. 2 of the drawings would be similar in construction to the embodiment of FIG. 10 of the drawings which will be described in greater detail below.

Figure 5:
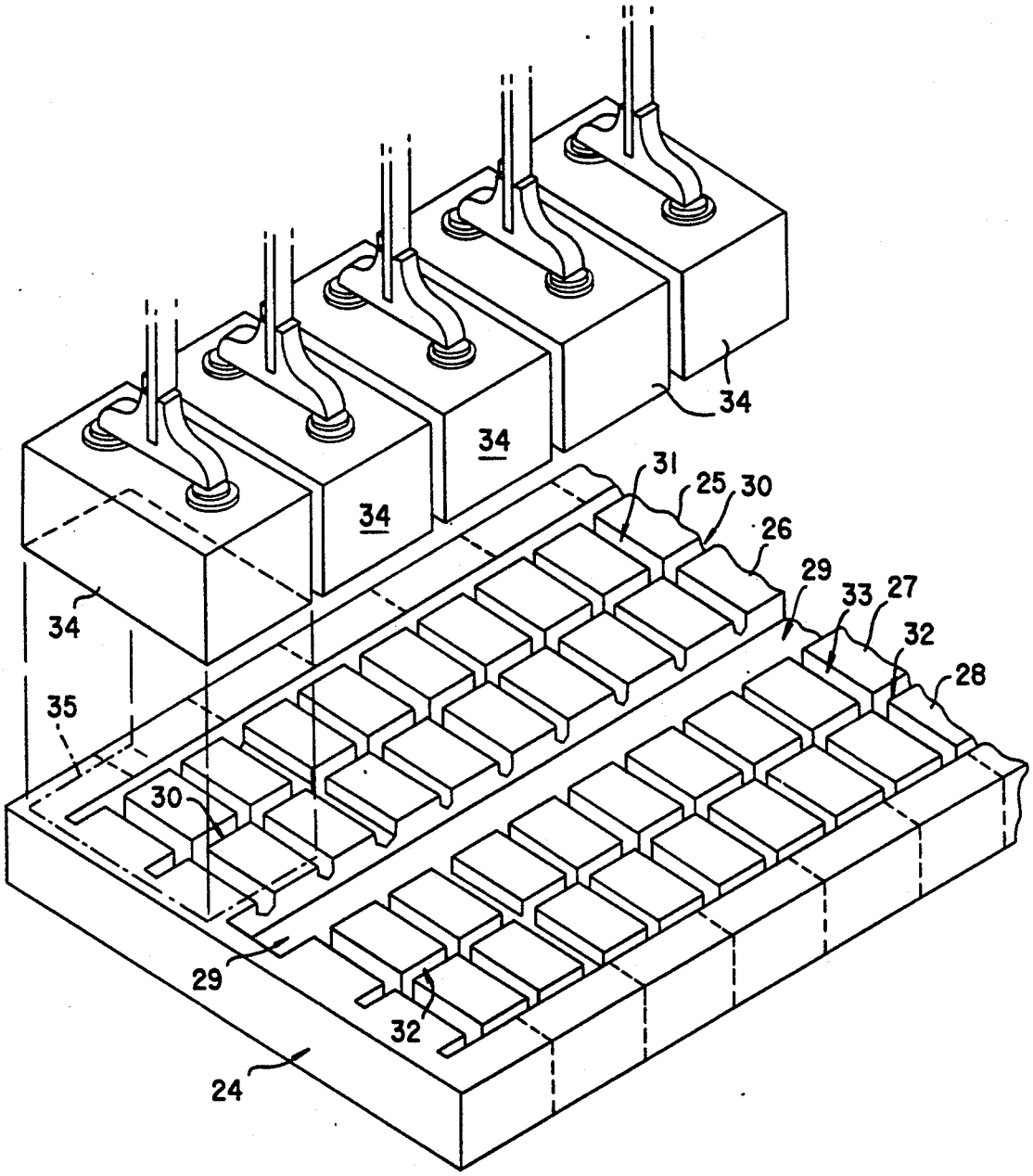
FIG. 5 is a partly schematic perspective view of a cathode and anode arrangement based on the principal shown in FIG. 4 of the drawings.

A further embodiment developed from the principle shown in FIG. 4 of the drawings is shown in greater detail in FIG. 5 of the drawings, in which the side walls and end walls of the cell have been omitted for greater clarity. In this embodiment, the cathode 24 is formed with two rectangular arrays of pairs of rectangular projections 25,26 and 27,28 positioned on either side of a central metal collection channel 29 and separated by longitudinal and transverse slots 30,31 and 32,33, within which pools of metal may be allowed to collect, in the manner shown in FIG. 4, for eventual discharge into the central channel 29. At least the horizontal surfaces of the projections or protrusions 25 to 28 and the slots 30 to 33 is covered by a suitable wetted cathode material, such as a $TiB_2$-containing composite of the type known in the art. An array of anodes 34 is positioned in overlying relationship with the array of protrusions 25,26 and 27,28, although the anodes over the array of protrusions 27,28 has been excluded for clarity and the array of anodes over the array of protrusions 25,26 is shown at an exaggerated elevated position also for reasons of clarity. The shadow 35 of one anode is illustrated in FIG. 5.

The cell design shown schematically in FIG. 5 of the drawings was trialled in a 90,000 A reduction cell having twenty anodes each 865 mm long by 525 mm wide. The cell was operated with three different slot widths to determine the height H of the peak 36 associated with each slot 31,33 located centrally of each anode 34. In each case, the slot was 80 mm deep in a $TiB_2$ composite approximately 100 mm deep over a cathode block approximately 220 mm deep. The results obtained are detailed in Table 1 below.

TABLE 1

| CATHODE SLOT WIDTH, W (mm) | PREDICTED PROTRUSION HEIGHT, $H_p$ (mm) | ACTUAL PROTRUSION HEIGHT, $H_a$ (mm) |
|---|---|---|
| 50 | 0 | 0–6 |
| 75 | 10 | 10–12 |
| 100 | 15 | 14–17 |

The peak 36 is shown schematically in FIG. 6 of the drawings.

Figure 9A:
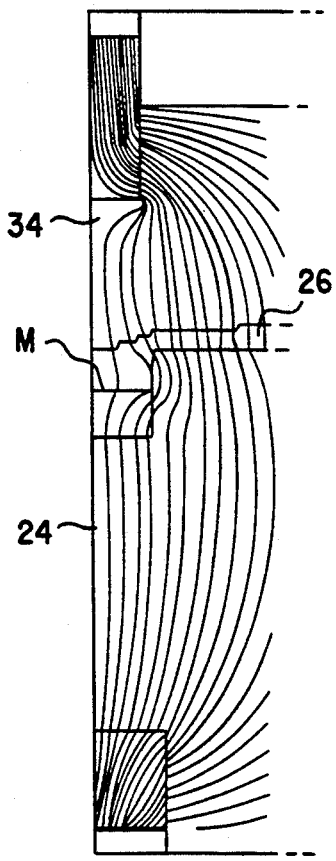
FIGS. 9A and 9B are schematic representations of the 5% current distribution lines produced for the embodiments of FIGS. 5 and 7.

FIG. 9A of the drawings represents part of a half end section of one anode and corresponding cathode according to FIG. 5 showing the 5% current distribution lines applicable to the anode and cathode structures shown. The current distribution lines indicate that current is conducted through both the protrusions 25,26 and through the cathode areas 24 within the slots 30 and 31 via the metal M stored in the slots 30 and 31. The profile induced in the active face of the anode as a result of the current distribution shown is clearly evident, and it will be appreciated that a similar, although more elongate, profile will be induced in the longitudinal direction of the anode.

An improved power efficiency was obtained over a conventional deep metal pad reduction cell from this trial which included metal storage in the channels and metal flooding onto the cathode. The improved power efficiency was achieved by operation at a low ACD (<20 mm).

Unexpectedly no metal shorting problems (as evidenced by the low cell noise) were encountered during periods when metal flooded onto the cathode surface. The magnetic effects which limit operation to an ACD of approximately 4–5 cm in a deep metal pad reduction cell did not limit operation in this cell. The essentially flat and wetted cathode design employed in this cell resulted in the cell noise being similar to the cell noise from a conventional deep metal pad reduction cell.

Once again no electrolyte circulation problems were encountered during operation with an essentially flat cathode at a low ACD.

Actual anode profiles examined from this cell were in good agreement with electrical model predictions as will be noted from Table 1. The 5 mm electrical model precision resulted in some minor differences for the 50 mm cathode slot width. However, it is apparent that a stepped metal/solid cathode can be successfully employed to control the anode profile. Therefore the novel metal storage techniques described above are open to incorporation into future high energy efficiency design cells.

The cell designs discussed above have shown substantial improvements in performance over conventional cells of the same size, yet have not necessarily required the draining of metal away from the active cathode surface to a remote sump. These experimental cells have operated at considerably lower ACD and have had lower power usage. Even with build up of metal to the top of the protrusions, the electrical noise level (indicating unwanted metal movement) has been significantly less than in conventional cells. This construction allowed the use of a smaller sump region and/or longer tapping cycles, compared to drained cathode cells.

The embodiment of FIG. 2 of the drawings was similarly trialled in a 100,000 A reduction cell having anodes 865 mm×525 mm. This test cell is shown schematically in FIG. 7 of the drawings in which an array of triangular protrusions 8 and 9 is positioned on either side of a central metal collection channel 36, with each array of protrusions 8 and 9 having overlying anodes 13 (with one array excluded for clarity). The profile formed on the active face of each anode 13 as the cell operates corresponds to the profile of the cathode 10 between the respective protrusions 8 and 9 and is a more accurate representation of the actual profile which is burnt into the active face of the anode 13 than the schematic profile shown in FIG. 2 of the drawings. FIG. 8 of the drawings is a representation of the actual anode profile achieved in the cell shown in FIG. 7 of the drawings by the use of the cathode protrusions shown.

Figure 7:
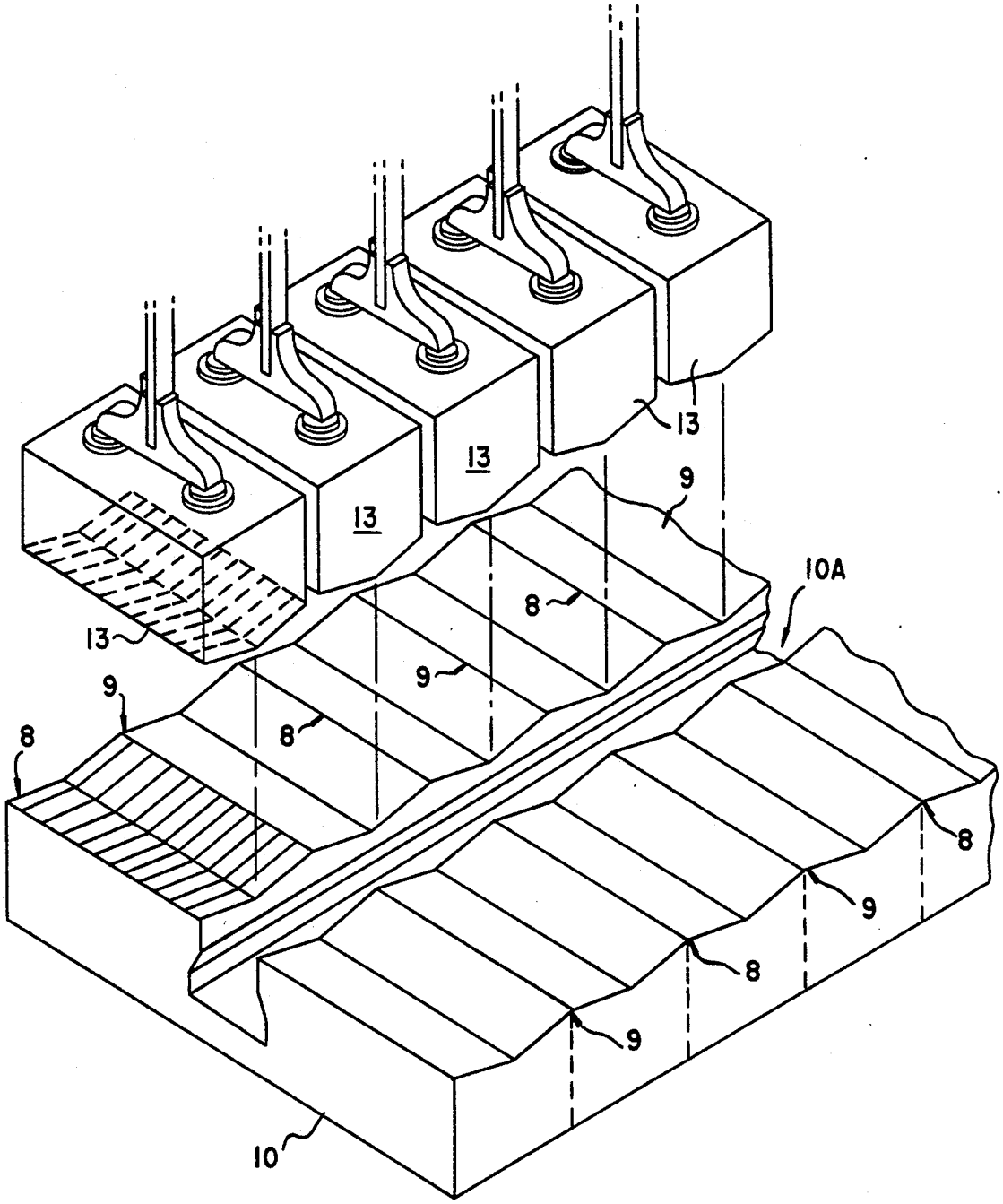
FIG. 7 is a partly schematic perspective view of a cathode and anode arrangement based on the principle shown in FIG. 2 of the drawings.
Figure 8:
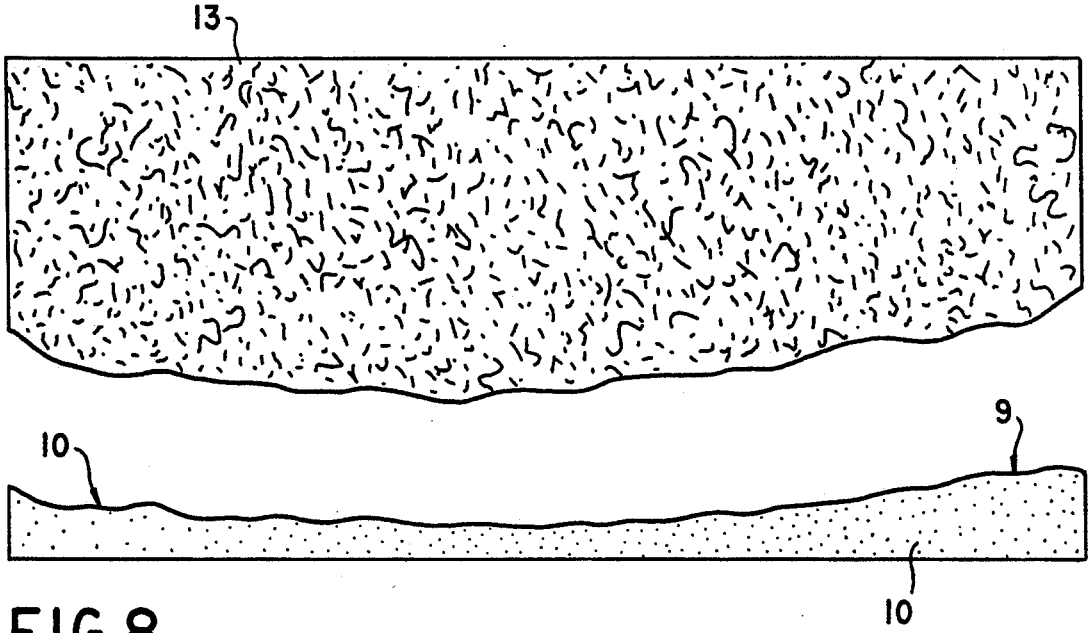
FIG. 8 is an end elevation representation of the anode and cathode profiles measured in a test cell constructed according to the embodiment of FIG. 7.
Figure 9B:
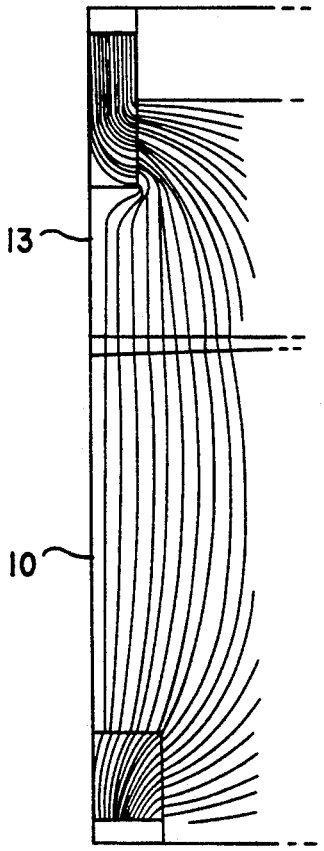

FIG. 9B shows the 5% current distribution diagram for the cell of FIG. 7 showing the effect of current distribution in shaping the anode 13 in the manner shown.

Figure 10:
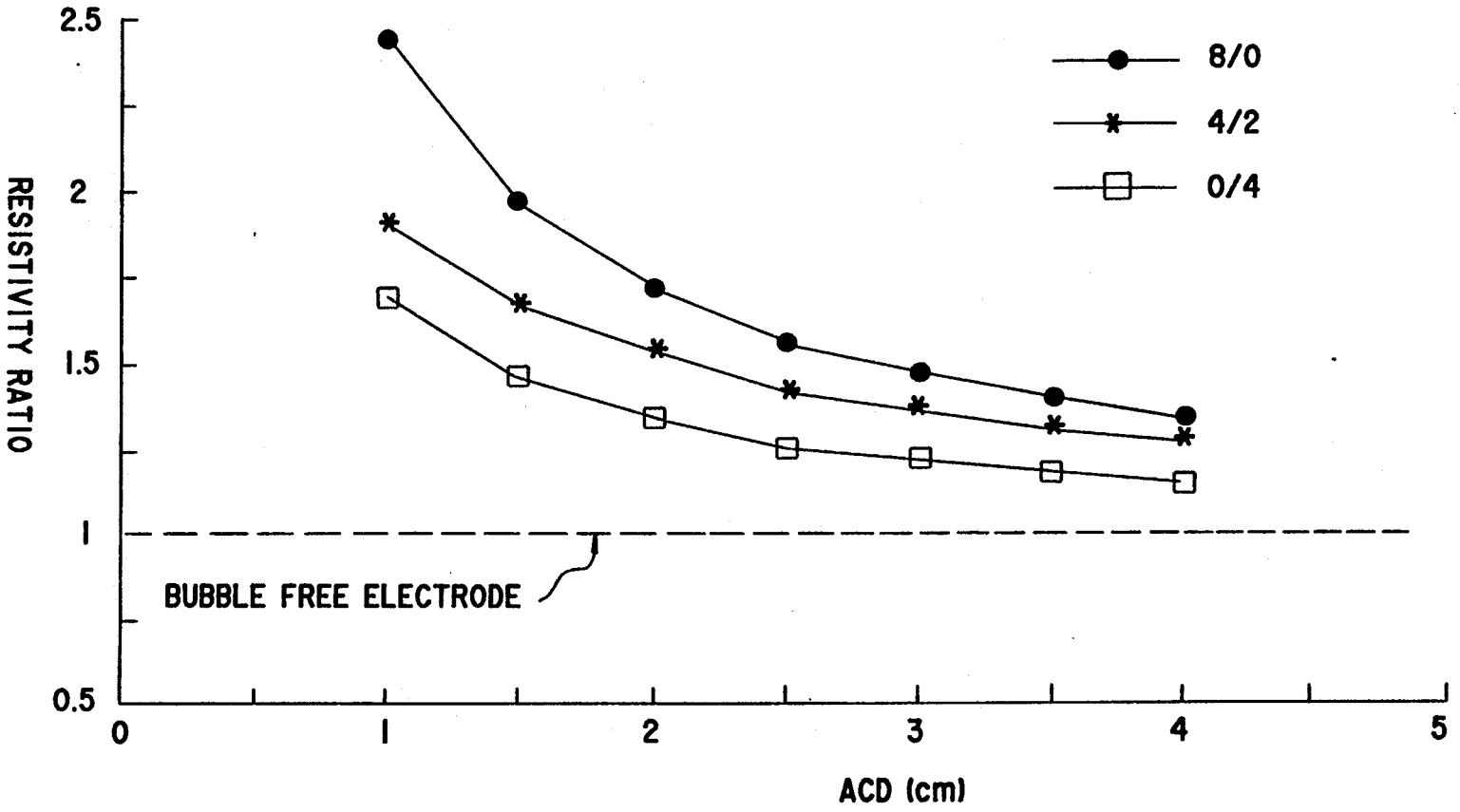
FIG. 10 is a graph showing the relationship between electrolyte resistivity ratio and anode to cathode distance for three different cell constructions.
Figure 11:
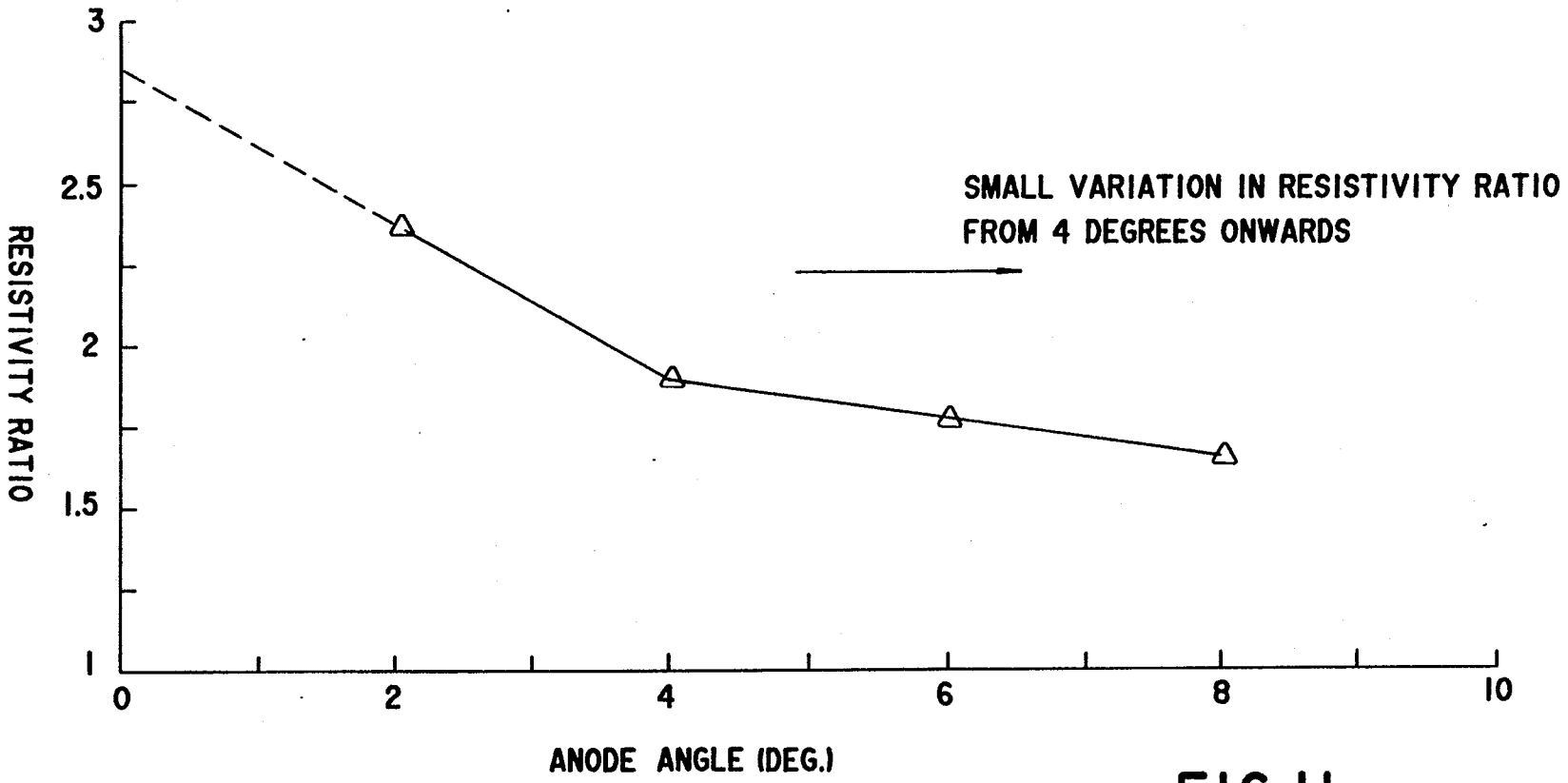
FIG. 11 is a graph showing resistivity ratio against anode angle 435 mm bubble path length, 1.1 $A/cm^2$ anode current density.
Figure 12:
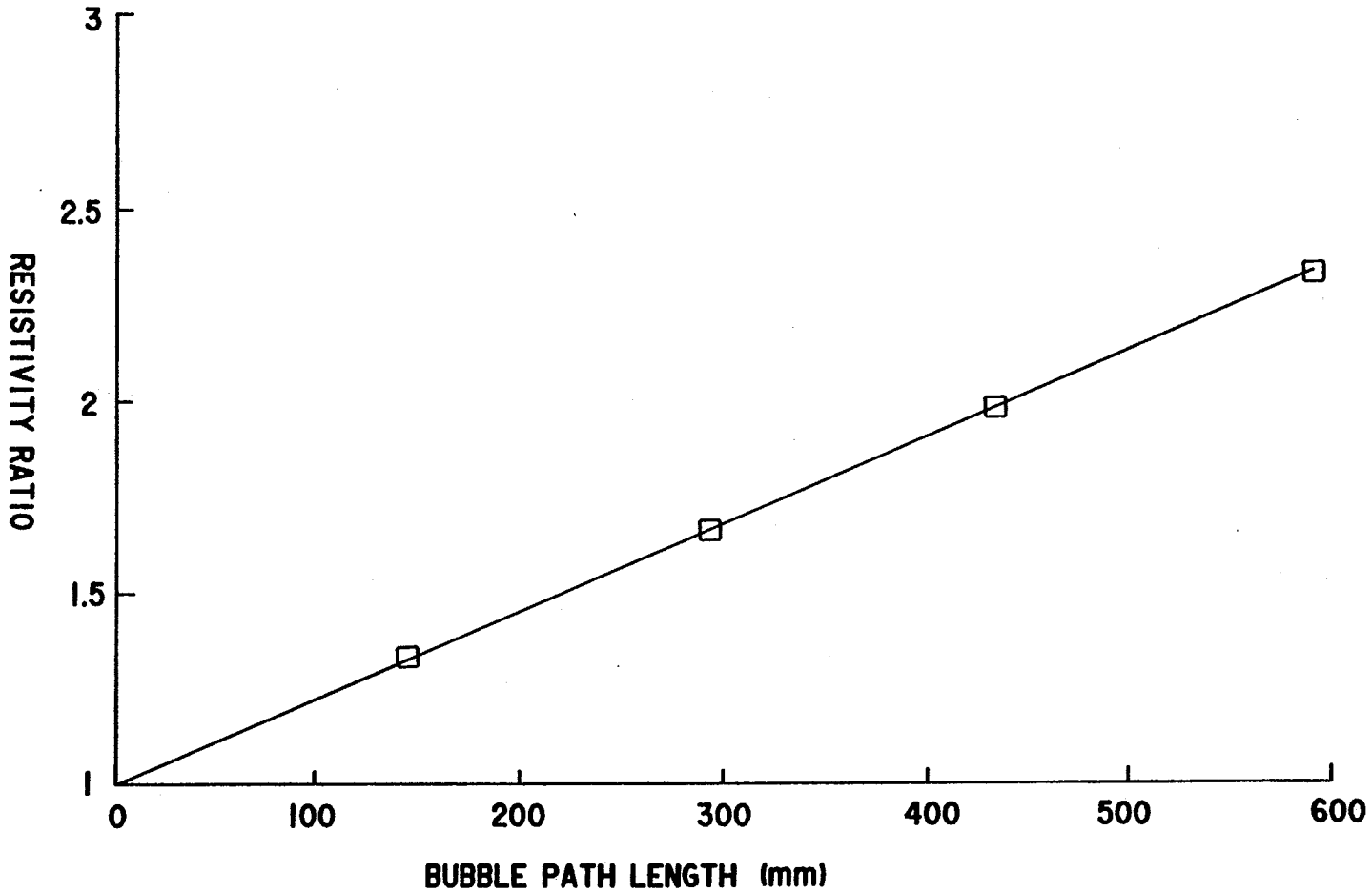
FIG. 12 is a graph of resistivity ratio against bubble path length (4 degree anode, 1.1 A $/cm^2$ anode current density)

The object of the trial using the cell of FIG. 7 of the drawings was to achieve a reduced cell voltage at an anode to cathode distance (ACD) of 20 mm whilst employing a conventional electrolyte chemistry (approx. 10% excess aluminium fluoride, 4% calcium fluoride and balance cryolite). Results from the operation of this cell are summarized in FIGS. 10 to 12 of the drawings and in Table 2 below. Table 2 compares the operation of the cell of FIGS. 5 and 7 with that of a conventional cell having a metal pad. FIG. 10 compares these embodiments with a drained cell, having a primary cathode slope of 8° in the longitudinal direction of the anode, and a secondary cathode slope of 0° in the transverse direction of the anode (known as 8°/0°), according to the Boxall et al patent referred to above. It is evident from FIG. 11 that the bubble layer resistance decreased as the longitudinal anode angle was increased from 0° to 8° although there was only a minor benefit gain from increasing the anode angle above about 4°. Venting of all bubbles across the anode width into the spaces between anodes yielded a reduced bubble layer resistance beneath the anode and this led to a reduced cell voltage. The effect of bubble path length on resistivity ratio is illustrated in FIG. 12.

TABLE 2

COMPARISON OR RESULTS

| | FIG. 7 | FIG. 5 | Conventional Metal Pad |
|---|---|---|---|
| Voltage | 4.0 | 4.2 | 4.6 |
| Current (kA) | 100 | 90 | 90 |
| Power Efficiency (DC kWhr/kg) | 1.5 | 14.1 | 15.2 |
| Average Cell Noise μΩ | 0.10 | 0.2–0.25 | 0.2–0.25 |
| AE frequency (AEs/day) | 0.03 | <0.1 | ~1 |
| ACD (mm) | 10–20 | <20 | ~50 |

Contrary to existing theory (Boxall et al) no electrolyte circulation problems were encountered with the test cell shown in FIG. 7 of the drawings notwithstanding the absence of cathode slope in the longitudinal direction of the anode and at a reduced ACD of 20 mm. No anode effect problems were encountered at this low ACD and the anode effect frequency was in fact lower than for typical conventional metal pad reduction cells of the type operated by the applicant. The short bubble path length beneath the anodes resulting from the 4° transverse cathode slopes inducing a similar profile in the anode led to rapid release of small bubbles from beneath the anode and significantly lower noise level was observed as a result.

Whilst it has been shown that very low ACD operation was found to be possible without a strongly induced bath flow to ensure a good supply of alumina-enriched bath into the electrolysis zone, the placement of the protrusions at the outer edges of the anodes as mentioned briefly above, may be adopted to induce bath flow if this is found to be necessary. It will be appreciated that the provision of such cathode protrusions in the cell is far less expensive than the construction of a sloping cell floor as described in U.S. Pat. No. 4,602,990. However, the profiling of the outer edge of each anode could be used to provide electrolyte flow by increased bubble release in that direction thereby achieving the objective of the cell described in the above U.S. patent. Such protrusions will induce the burning of a steep smoothly curved bevelled surface and the bubble pumping action caused by the shaped surface will produce a net movement of electrolyte in the interelectrode gap and along the length of the active surface of the anode. Thus, by the strategic placement of cathode protrusions or abutments, the desired electrolyte bath flow and controlled bubble release requirements of the cell may be achieved in a particularly economic manner.

A protrusion/abutment arrangement for achieving a desired electrolyte bath flow and controlled bubble release in a different manner to that described above is shown schematically in FIGS. 13 and 14 of the drawings in which angularly positioned cathode protrusions 37, 38, 39 and 40 extend angularly inwardly from the edges of the anode shadow 41, and a further cathode abutment 42 is formed at the outer edge of the anode shadow 41 adjacent the side channel or side wall of the cell.

Figure 14:
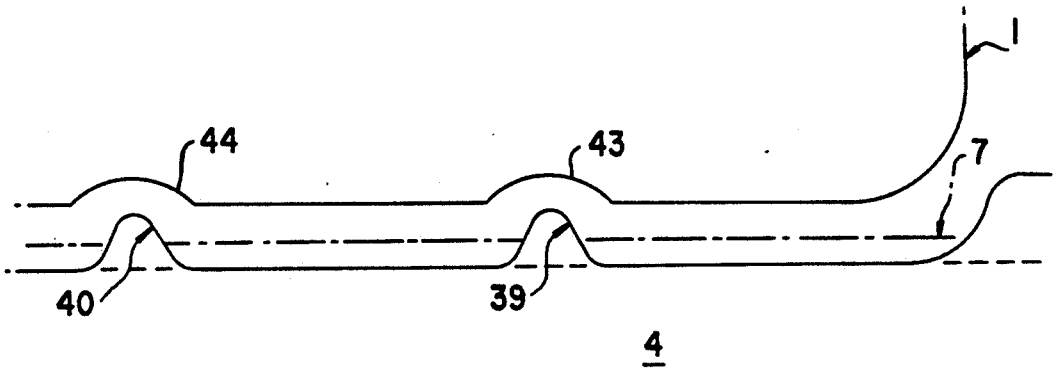
FIG. 14 is a sectional side elevation taken along the line 14—14 in FIG. 13.

This protrusion arrangement may be particularly advantageous if the anodes to be used are large. The positioning of the angular protrusions 37 to 40 causes channels 43 and 44 to be profiled within the anode 1, as shown in FIG. 14, to give more concentrated gas venting within specific regions of the anode, which in turn reduces the bubble path length of the bubbles under most of the anode. The position and size of each protrusion to be used will depend upon the dimensions of the cell and its operating characteristics. Electrical modelling can be used to assist in the design of the cell in this regard. The height and width of the protrusions would typically be similar to those as shown and described in relation to FIG. 1 of the drawings. This type of arrangement may be attractive where dimensionally stable anodes are being used (inert anodes) or continuous prebaked blocks, since the anode profile may be more easily maintained throughout the operation of the cell by the use of this type of protrusion.

It will be appreciated that where non-consumable or inert anodes are used, the outermost edges of the anodes would be suitably shaped prior to installation and the cathode protrusions would not be required for profiling, although some shaping of the floor and side wall of the cell may be necessary for metal storage to allow a reduced ACD, or to promote proper electrolyte flow, and to provide the necessary cooperative shapes in the anode and cathode for a good parallel geometric fit. In the case of consumable anodes, the cathode protrusion may take the form of a shaped floor and wall portion of the cell rather than a distinct abutment as shown in FIG. 8 of the drawings.

We claim:

1. An aluminum smelting cell comprising side walls and a floor defining a cathode surface, at least one anode having an active electrode surface spaced from and substantially parallel to said cathode surface to define an interelectrode gap, said cathode surface being substantially horizontal in the longitudinal direction of said anode(s) and shaped structures projecting from said cathode surface, said shaped structures being covered by wetted cathode material and being shaped to modify the current distribution between the anode(s) and the cathode whereby current flows through said shaped structures and through the remaining cathode portions to cause preferential shaping of the anode(s) to encourage shortening of the release path of bubbles under said anode(s) to thereby minimize cell resistivity and enable operation at a reduced anode to cathode distance, said cathode surface having regions adjacent said shaped structures, said regions being active cathode areas.

2. The cell of claim 1, wherein the shaped structures comprise a pair of shaped structures extending longitudinally of the or each anode to cause rounding or chamfering of the longitudinal edges of the or each anode to encourage bubble release at these edges.

3. The cell of claim 2, wherein the shaped structures are generally triangular and are spaced to provide a region of generally horizontal cathode surface therebetween.

4. The cell of claim 3, wherein said shaped structures are of rounded generally triangular shape.

5. The cell according to claim 4, wherein each grounded triangular shaped structure has a peak having a height of the order of 5 to 100 mm above the desired average operating metal depth between the shaped structures, a width of the order of 2 to 5 times this dimension, and a spacing between the peaks of the protrusions of the order of the width of the anode.

6. The cell of claim 1, wherein said shaped structures are generally triangular and extend transversely from a position centrally of the or each anode to positions substantially coincident with the longitudinal edges of the anode.

7. The cell of claim 1, wherein said shaped structures are substantially rectangular and are spaced so as to be positioned adjacent the longitudinal edges of the or each anode.

8. The cell of claim 1, wherein said shaped structures are generally rectangular and are spaced along a narrow central region of the anode to produce a downwardly projecting protrusion extending centrally of the anode to encourage bubble release transversely of the anode.

9. The cell of claim 1, further comprising secondary shaped structures between the spaced shaped structures positioned to reduce unwanted metal movement between the shaped structures and to define a defined anode to cathode distance that induces anode profiling when the metal is at least at a lower level between said shaped structures.

10. The cell of claim 1, wherein said shaped structures are defined by channels formed in the generally horizontal cathode surface to define a rectangular array of spaced rectangular protrusions, the channels being adapted to be at least partly filled with metal whereby the channels define active cathode regions.

11. The cell according to any one of claims 1 to 10, wherein said shaped structures are separately constructed and rest on the cathode surface without any bonding or fixing.

12. The cell of claim 1, wherein the shaped structures are formed integrally with the cathode surface.

13. The cell of claim 1, wherein said shaped structures extend angularly of the anode(s) towards the longitudinal edges of the anode(s).

14. The cell of claim 13, further comprising a shaped structure extending transversely of the anode(s) near its outer edge.

* * * * *